US005794315A

United States Patent [19]

Crabtree et al.

[11] Patent Number: 5,794,315

[45] Date of Patent: Aug. 18, 1998

[54] NON-REOPENING FASTENER FOR PLASTIC PACKAGING AND METHOD OF FORMING SAME

[75] Inventors: Larry W. Crabtree, Morristown, Tenn.; Jack L. Rosette, Ft. Mill, S.C.; Samuel T. Webb, Talbott, Tenn.

[73] Assignee: Lin Pac, Inc., Atlanta, Ga.

[21] Appl. No.: 580,194

[22] Filed: Dec. 28, 1995

[51] Int. Cl.[6] ..... B65D 33/00; B65D 33/16; B65D 33/24

[52] U.S. Cl. ..... 24/587; 24/30.5 R; 383/63

[58] Field of Search ..... 383/107, 62–65; 24/30.5 R, 575–577, 587, 399

[56] References Cited

U.S. PATENT DOCUMENTS

| | | | |
|---|---|---|---|
| 3,266,924 | 8/1966 | Haeske et al. | 106/308 |
| 3,338,285 | 8/1967 | Jaster | 24/587 X |
| 3,416,199 | 12/1968 | Imamura | 24/201 |
| 4,483,018 | 11/1984 | Whelan | 383/5 |
| 4,557,505 | 12/1985 | Schaefer et al. | 283/81 |
| 4,578,813 | 3/1986 | Ausnit | 383/65 |
| 4,673,383 | 6/1987 | Bentsen | 493/381 |
| 4,787,880 | 11/1988 | Ausnit | 493/213 |
| 4,792,240 | 12/1988 | Ausnit | 24/587 X |
| 4,846,586 | 7/1989 | Bruno | 383/9 |
| 4,907,321 | 3/1990 | Williams | 24/587 |
| 4,998,666 | 3/1991 | Ewan | 229/102 |
| 5,060,848 | 10/1991 | Ewan | 229/102 |
| 5,064,664 | 11/1991 | Hustad | 426/87 |
| 5,067,822 | 11/1991 | Wirth et al. | 383/61 |
| 5,077,001 | 12/1991 | Makowka | 383/5 |
| 5,082,702 | 1/1992 | Alband | 428/36.92 |
| 5,094,707 | 3/1992 | Bruno | 156/244 |
| 5,103,979 | 4/1992 | Hustad | 206/459 |
| 5,104,704 | 4/1992 | Labes et al. | 428/35.7 |
| 5,118,202 | 6/1992 | Bruno | 383/37 |
| 5,119,531 | 6/1992 | Berger et al. | 24/576 |
| 5,188,461 | 2/1993 | Sorensen | 383/63 |
| 5,211,481 | 5/1993 | Tilman | 383/63 |
| 5,232,966 | 8/1993 | Chen et al. | 524/224 |
| 5,235,731 | 8/1993 | Anzai et al. | 24/587 X |
| 5,237,078 | 8/1993 | Chen et al. | 554/35 |
| 5,238,306 | 8/1993 | Heintz et al. | 393/61 |
| 5,248,201 | 9/1993 | Kettner et al. | 383/63 |
| 5,308,666 | 5/1994 | Borchardt | 428/35.2 |
| 5,318,364 | 6/1994 | Raden | 383/5 |
| 5,334,127 | 8/1994 | Bruno et al. | 493/194 |
| 5,356,222 | 10/1994 | Kettner et al. | 383/63 |
| 5,366,294 | 11/1994 | Wirth et al. | 24/587 X |
| 5,368,394 | 11/1994 | Scott et al. | 24/587 X |
| 5,393,814 | 2/1995 | Chen | 524/219 |
| 5,403,094 | 4/1995 | Tomic | 383/63 |
| 5,425,825 | 6/1995 | Rasko et al. | 156/66 |
| 5,435,864 | 7/1995 | Machacek et al. | 156/66 |
| 5,456,928 | 10/1995 | Hustad et al. | 426/87 |
| 5,462,360 | 10/1995 | Tilman et al. | 24/587 X |
| 5,520,463 | 5/1996 | Tilman | 24/587 X |
| 5,588,187 | 12/1996 | Swain | 24/587 |

FOREIGN PATENT DOCUMENTS

| | | |
|---|---|---|
| 1483652 | 6/1966 | France . |
| 287845 | 8/1950 | Germany . |
| 2264281 | 8/1993 | United Kingdom . |
| 2270857 | 3/1994 | United Kingdom . |

*Primary Examiner*—Peter M. Cuomo
*Assistant Examiner*—Robert J. Sandy
*Attorney, Agent, or Firm*—Finnegan, Henderson, Farabow, Garrett & Dunner, L.L.P.

[57] ABSTRACT

A non-reopening fastener includes complimentary first and second profiles of substantial length and disposed adjacent to one another so as to be pressed into interlocking relation. The first profile includes first ribs including a main rib and two outer ribs disposed on opposite sides of the main rib. The first ribs include hook members along the width of the first ribs. The second profile includes two inner ribs adapted to be positioned between the outer ribs and the main rib. The two inner ribs have projections for engaging the hook members. The second profile also includes a pair of guide ribs disposed on opposite ends of the second profile. The first profile engages the second profile to lock the profiles together. The above configuration prevents the first profile from being pulled out of the second profile without damaging the fastener or a bag to which the fastener is attached, thereby providing evidence of tampering.

32 Claims, 2 Drawing Sheets

NON-REOPENING FASTENER FOR PLASTIC PACKAGING AND METHOD OF FORMING SAME

BACKGROUND OF THE INVENTION

The present invention relates to a non-reopening fastener for package, a tamper-evident bag including the non-reopening fastener, and method of forming the bag. More particularly, the present invention pertains to a plastic profile fastener providing a substantially permanent locking mechanism useful in certain types of packaging, such as tamper evident bags, and to a unique method of making a bag having such a locking mechanism.

The advantages of plastic packaging with locking fasteners, capable of essentially permanently securing an opening of a bag, are well-known. For example, seals formed with conventional heat weldable material are effective in providing a long-lasting seal. Obviously, however, additional equipment is required to heat seal the bags, thereby making this method impractical for general use.

Other conventional methods include utilizing adhesive to secure interlocking profile members. In this regard, U.S. Pat. No. 4,791,710 discloses a bag with male and female closure elements having engaging ribs, as well as an adhesive layer inside and at the bottom of the female closure element.

Use of adhesive in the fastener mechanism creates its own set of problems. The adhesive may be difficult to apply, sensitive to variations in temperature, and susceptible to leakage, and may cause adjoining bags to stick together. As such, locking mechanisms that need adhesive to facilitate a permanent bond may not be desirable.

SUMMARY OF THE INVENTION

Accordingly, the present invention is directed to a non-reopening fastener, bag utilizing such a fastener, and method for forming such a bag that substantially obviates one or more of the limitations of the related art.

To achieve these and other advantages in accordance with the purpose of the invention, as embodied and broadly described herein, the non-reopening fastener comprises complimentary first and second profiles of substantial length and disposed adjacent to one another so as to be pressed into interlocking relation. The first profile includes a first base and first ribs integrally connected to the first base. Each of the first ribs extend a predetermined width along the length of the fastener. The first ribs include a main rib and two outer ribs disposed on opposite sides of the main rib. The first profile also includes first grooves spacing the outer ribs from the main rib. The first ribs include projecting hook members spaced relative to one another along the width of the ribs.

The second profile of the fastener includes a second base and two inner ribs integrally connected to the second base. The two inner ribs are adapted to be positioned within the first grooves. The two inner ribs have projections for engaging the hook members and for maintaining the second profile along the first grooves. The second profile also includes a pair of guide ribs integrally connected to the second base and disposed on opposite ends of the the second profile. The first profile is movable into engagement with the second profile to lock the first and second profiles together along the hook members and projections, respectively. This design prevents the first profile from being pulled out of the second profile without damaging the fastener or a bag to which the fastener is attached.

Preferably, the first ribs of the first profile extend orthogonally from the first base. The hook members of the first ribs have a contacting surface facing generally toward the first base at an orientation which is preferably 40–80° from a plane passing through the width of the first ribs. Preferably, the two inner ribs and pair of guide ribs of the second profile extend orthogonally from the second base. The projections of the two inner ribs have a contacting surface facing generally toward the second base at an orientation which is preferably 40–80°from a plane passing through the width of the two inner ribs. Preferably, the pair of guide ribs guide each of the two outer ribs between one of the two inner ribs and an adjacent one of the pair of guide ribs. The pair of guide ribs also guide the main rib between the two inner ribs.

The preferred fastener has a single hook member directed toward the main rib on each of the two outer ribs. The main rib preferably has two hook members in which each of the two hook members is directed towards one of the two outer ribs. Each of the two inner ribs preferably has two projections. One of the two projections engages one of the hook members of the main rib and the other of the two projections engages one of the outer ribs.

The preferred first and second profiles are formed of low density polyethylene. The preferred low density polyethylene includes between 30–120 parts per million (ppm) of a slip agent, which more preferably consists of Erucimide or Oleamide. The preferred low density polyethylene also includes between 500–2,000 ppm of an anti-blocking agent, which more preferably consists of diatomaceous earth.

In another embodiment, the non-reopening fastener is included in a tamper-evident bag comprising opposing wall panels having an open side. A locking profile assembly or non-reopening fastener extends a predetermined length along an inside surface of the wall panels proximate the open side. The bag also includes means disposed along the bag for obtaining access to the bag. The preferred access means includes perforations or a tear strip along at least one of the wall panels. The tear strip or perforations preferably are oriented between 0.1–0.25 inches below the profile to permit opening of the bag. The wall panels of the bag preferably have one of a hot air weld or sonic weld along the bottom of the bag. The bag also includes two spaced seals along the side edges of the bag. One of the two spaced seals is preferably a hot air weld, while the other is preferably a sonic weld. The two space seals preferably have an air pocket approximately 0.25–0.5 inches wide between the two spaced seals.

Preferably, the wall panels of the bag have a predetermined first strength, and the locking assembly or non-opening fastener when in the locked position has a predetermined second strength against being opened. The second strength is greater than that of the first strength such that the wall panels will deform and tear before the locking assembly will open.

According to the present invention, the bag may be presented to customers with the profiles separated. In other words, the profiles may be attached to a bag and left disengaged until the bag is filled. However, when the first and second profiles are locked together, the profiles cannot be separated without damaging the profiles or the bag.

Additionally, the invention includes a method of making a bag having a non-reopening plastic locking assembly comprising the steps of: forming, by extruding, a first profile of the locking assembly adapted to be joined to a wall of the bag, the first profile having formed thereon a first base; forming, by extruding, a second profile of the locking assembly adapted to be joined to a wall of the bag, the second profile having formed thereon a second base, the first and second profiles being configured to interlock with one another; interlocking the first profile and the second profile; providing a tube of film having wall panels and an open side; attaching the first and second bases of the interlocked first and second profiles respectively along opposed inside surfaces of the wall panels proximate the open side; splitting the interlocked first and second profiles to separate the first profile from the second profile; and sealing the first and second profiles together at two locations to form edges of the locking assembly while maintaining the locking assembly in an open position until engaged by a user.

It is to be understood that both the foregoing general description and the following detailed description are exemplary, and are intended to provide further explanation of the invention, as claimed.

BRIEF DESCRIPTION OF THE DRAWINGS

The accompanying drawings are included to provide a further understanding of the invention and they are incorporated in and constitute part of this specification. The drawings illustrate embodiments of the invention and, together with their description, serve to explain the principles of the invention. In the drawings.

A DESCRIPTION OF THE PREFERRED EMBODIMENT

Reference will now be made in detail to the present preferred embodiments of the invention, examples of which are illustrated in the accompanying drawings.

Figure 1:
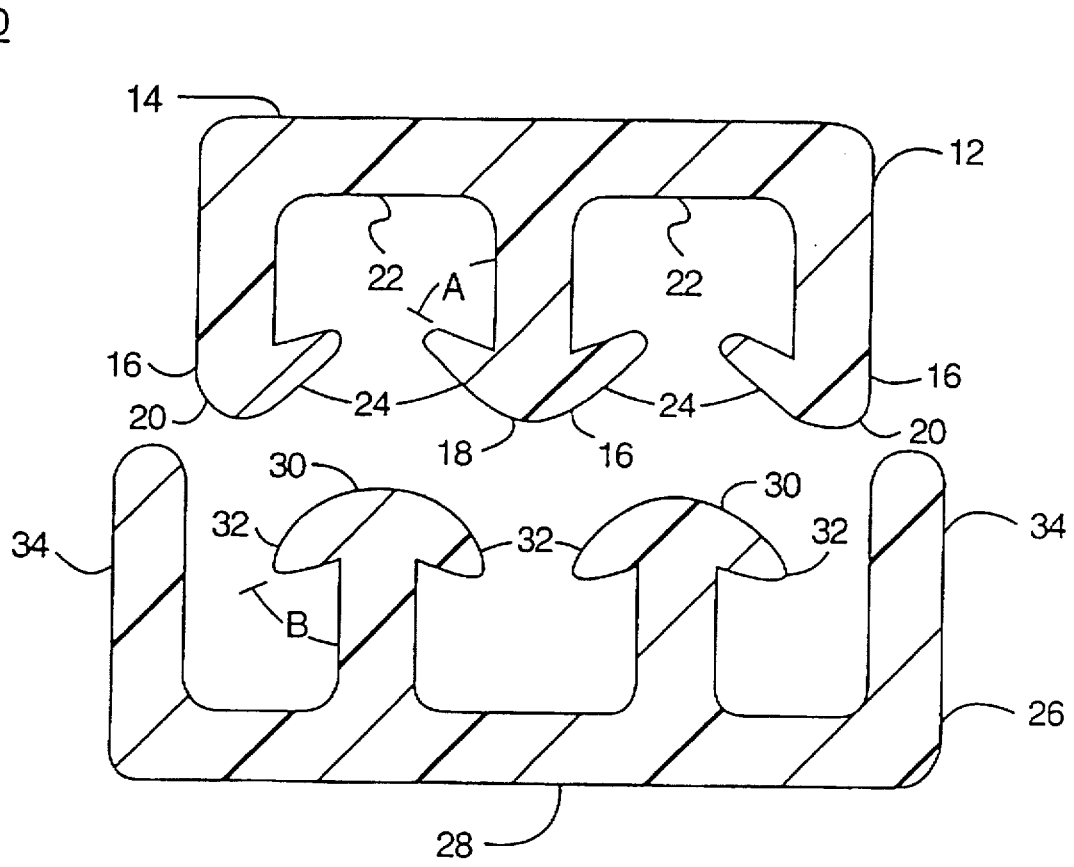
FIG. 1 is a cross-sectional view of an unengaged non-reopening fastener of the present invention.
Figure 2:
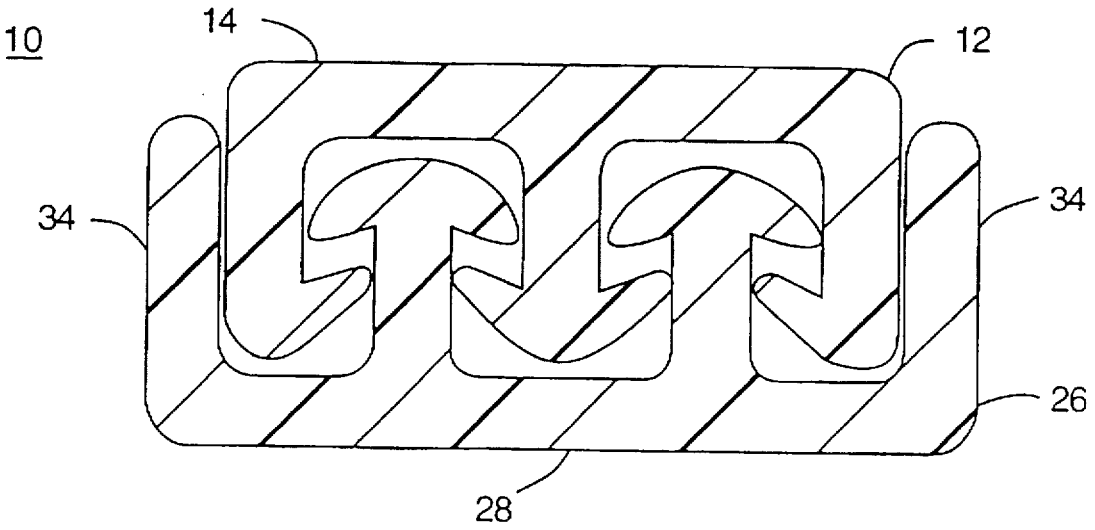
FIG. 2 is a cross-sectional view of an engaged non-reopening fastener of the present invention.
Figure 3:
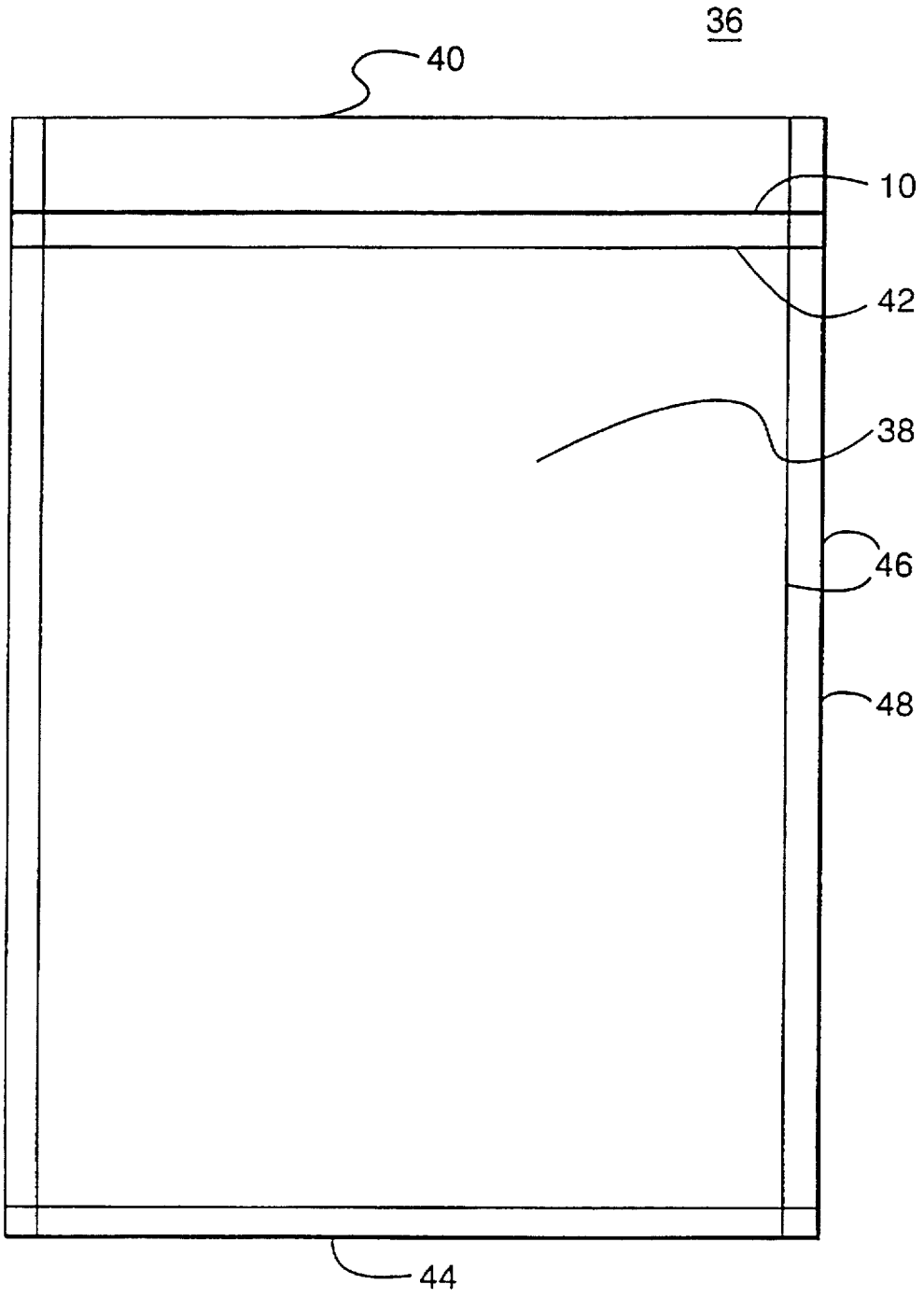
FIG. 3 is a front elevational view of the bag of the present invention.

In accordance with the present invention, a non-reopening fastener comprises complimentary first and second profiles of substantial length and disposed adjacent to one another so as to be pressed into interlocking relation. As embodied herein and shown in FIGS. 1 and 2, the non-reopening fastener 10 includes a first profile 12 including a first base 14 and first ribs 16 integrally connected to the first base 14. Each of the first ribs 16 extend a predetermined width along the length of the fastener 10. The first ribs 16 include a main rib 18 and two outer ribs 20 disposed on opposite sides of the main rib 18. The first profile 12 also includes first grooves 22 spacing the outer ribs 20 from the main rib 18. The first ribs 16 include projecting hook members 24 spaced relative to one another along the width of the first ribs 16.

The second profile 26 of the fastener 10 includes a second base 28 and two inner ribs 30 integrally connected to the second base 28. The two inner ribs 30 are adapted to be positioned within the first grooves 22 of the first profile 12. The two inner ribs 30 have projections 32 for engaging the hook members 24 of the first ribs 16 and for maintaining the second profile 26 along the first grooves 22 of the first profile 12. The second profile 26 also includes a pair of guide ribs 34 integrally connected to the second base 28 and disposed on opposite ends of the second profile 26.

The fastener 10 has a single hook member 24 directed toward the main rib 18 on each of the two outer ribs 30. The main rib 18 has two hook members 24 in which each of the two hook members 24 is directed towards one of the two outer ribs 20. Each of the two inner ribs 30 has two projections 32. One of the two projections 32 slidably engages one of the hook members 24 of the main rib 18, and the other of the two projections 32 slidably engages one of the outer ribs 20.

The first ribs 16 of the first profile 12 extend orthogonally from the first base 14. The hook members 24 of the first ribs 16 have a contacting surface facing generally toward the first base 14 at an orientation which is preferably 40–80° from a plane passing through the width of the first ribs 16, and generally designated angle A in FIG. 1. The two inner ribs 30 and pair of guide ribs 34 of the second profile 26 extend orthogonally from the second base 28. The projections 32 of the two inner ribs 30 have a contacting surface facing generally toward the second base 28 at an orientation which is preferably 40–80° from a plane passing through the width of the two inner ribs 30, and generally designated as angle B in FIG. 1. An orientation of 50–70° for angles A and B is most preferable for the contacting surface of both the first ribs 16 and the two inner ribs 30. The preferred angles A and B further ensure that the profiles stay together once engaged with one another.

The pair of guide ribs 34 guide each of the two outer ribs 20 between one of the two inner ribs 30 and an adjacent one of the pair of guide ribs 34. The pair of guide ribs 34 also guide the main rib 18 between the two inner ribs 30. The guide ribs 34 further ensure that a user of the fastener properly and positively engages the first and second profiles together. This feature helps prevent a misaligned engagement of the profiles which would permit the fastener to be reopened.

The first profile 12 is movable into engagement with the second profile 26 to lock the first profile 12 and second profile 26 together along the hook members 24 and projections 32, respectively. This hook member and projection configuration prevents the first profile 12 from being pulled out of the second profile 26 without damaging the fastener 10 or a bag to which the fastener 10 is attached, thereby providing evidence of tampering.

The preferred first profile 12 and second profile 26 are formed of 100% barefoot low density polyethylene, enabling the profiles 12, 26 to be rigid. Preferably, the polyethylene includes between 30–120 parts per million (ppm), and most preferably 60 ppm, of a fast blooming slip agent, such as Erucimide or Oleamide. The preferred polyethylene also includes between 500–2,000 ppm, and most preferably 900–1100 ppm, of an anti-blocking agent which consists of diatomaceous earth. These additives and others may be used in the extrusion process to control the rigidity of the hook members 24 and the projections 32, as well as to modify the frictional characteristics of the surfaces of these elements. The color of the fastener is natural to reduce the visibility of the sealing lines of the first and second profiles.

Typically, plastic profiles are formed from an extrusion process which produces the profiles as independent strands of webbing. After the webbing is cooled, the profiles are mated and wound on spools. Ordinarily, the profiles are unwound from the spools by machinery that applies the profiles to opposing surfaces of two sheets of plastic. The sheets are sealed and cut along the sides and bottom to form individual bags with the profiles extending along an open top portion of the bag. Eventually, the individual bags are arranged in stacks for shipping.

In accordance with another embodiment of the present invention, the non-reopening fastener 10 is included in a tamper-evident bag 36 comprising opposing wall panels 38 having an open side 40. A locking profile assembly or non-reopening fastener 10 extends a predetermined length along an inside surface of the wall panels 38 proximate the open side 40. The bag 36 also includes means disposed along the bag 36 for obtaining access to the bag 36. The preferred access means includes perforations or a tear strip 42 along at least one of the wall panels 38. The preferred tear strip 42 or perforations may be oriented between 0.1–0.25 inches below the bottom of the profile to facilitate opening of the bag 36 by the end user. When the bag is torn along the perforations or tear strip 42, the seal of the bag 36 becomes useless and the bag 36 cannot be resealed.

The wall panels 38 of the bag 36 preferably have one of a hot air weld or sonic weld along the bottom 44 of the bag 36 to create a seal approximately 0.25–0.5 inches wide. The bag 36 also includes two spaced seals 46 along the side edges 48 of the bag 36. Preferably, one of the two spaced seals 46 is a hot air weld and the other is a sonic weld. The two spaced seals 46 have an air pocket approximately 0.25–0.5 inches wide between the two spaced seals 46. These seals prevent the bag from being cut open and resealed without providing a change in the appearance of the bag.

Preferably, the wall panels 38 of the bag 36 have a predetermined first strength, and the locking assembly or non-opening fastener 10 when in the locked position has a predetermined second strength against being opened. The second strength is greater than that of the first strength such that the wall panels 38 will deform and tear before the locking assembly 10 will open. This feature is opposite that a typical bag with a reopening fastener in which the user grasps the wall panels of the bag to open the fastener. With the present invention, an attempt to open the fastener by pulling the wall panels apart will result in damages to the wall panels, fastener, or both, thereby providing evidence of tampering.

In accordance with the present invention, the bag is presented to customers with the bag open and the profiles separated, i.e., fully disengaged. Once the bag is formed (i.e., the profiles are cut and sealed at the edges) and the first profile is mated with the second profile, the bag essentially is permanently locked. Bending or pulling of the first profile 12 along its width urges at least one of the hook members 24 into interlocking engagement with one of the projections 32, thereby preventing the rib from being released from the groove.

The fastener of the present invention has particular utility in connection with tamper evident/resistant packaging. In view of the substantially permanent seal afforded by the fastener 10, suitable methods of obtaining access to the contents of the package would be visibly apparent. Any attempt to pry open the bag will cause the bag density to change, causing the bag to appear as if the bag itself is changing color due to the stretching of the film. Clear bags have a ½" wide solid stripe along the profile to achieve this objective. Consequently, even assuming the profiles 12, 26 could be separated once the second profile 26 is seated fully within the groove 22 of the first profile 12, the requisite opening forces would damage the bag 36 or the profiles 12, 26. Thus, the fastener 10 provides essentially a permanent seal, which only can be overcome by substantially high opening forces. Indeed, unless alternate means of access were provided, such as perforations or a tear strip 42, the bag 36 ordinarily would have to be cut open by scissors or the like.

Additionally, the invention includes a method of making a bag 36 having a non-reopening plastic locking assembly 10 comprising the steps of forming, by extruding, a first profile 12 of the locking assembly 10 adapted to be joined to a wall 38 of the bag 36, the first profile 12 having formed thereon a first base 14; forming, by extruding, a second profile 26 of the locking assembly 10 adapted to be joined to a wall 38 of the bag 36, the second profile 26 having formed thereon a second base 28, the first and second profiles 12, 26 being configured to interlock with one another; interlocking the first profile 12 and the second profile 26; providing a tube of film having wall panels 38 and an open side 40; attaching the first and second bases 14, 28 of the interlocked first and second profiles 12, 26, respectively along opposed inside surfaces of the wall panels 38 proximate the open side 40; splitting the interlocked first and second profiles 12, 26 to separate the first profile 12 from the second profile 26; sealing the first and second profiles 12, 26 together at two locations to form edges 50 of the locking assembly 10 while maintaining the locking assembly in an open position until engaged by a user.

In accordance with the present invention the steps of forming the first and second profile include forming the elements as described above for a non-reopening fastener. The step of attaching the first and second bases to opposed inside surfaces of the wall panels includes both the step of heat sealing and the step of applying adhesives. The step of splitting the interlocked first and second profiles to separate the first profile from the second profile includes the step of providing a bar and pulling the first profile to one side of the bar and pulling the second profile to the other side of the bar. The step of sealing the first and second profiles together to form edges of the interlocking assembly includes the step of welding the side edges of the bag. Additionally, the inventive method of the present invention includes the step of providing an additional seal along the side edges or the bottom of the bag.

The method of the present invention may further include the step of storing the bag once finished on one of its side edges to prevent closing of the bag. Additionally, a step of transporting the bag once finished on one of its side edges to prevent closing of the bag may be a further added step.

In accordance with the method of the present invention, the bag is manufactured in the open position by opening the fastener after the fastener is applied to the bag sidewalls. The fastener is separated using a rounded bar that causes one profile of the fastener to travel over the top of the bar and the other profile of the fastener to travel under the bar. The two profiles are then matched together and sonic sealed at a point that will become the side of the bag during the side sealing process. The trailing edge of the fastener and bag are sealed at the same time as the leading edge of the following bag on the production line. The finished bags are placed in cartons for shipping in the vertical direction on their side seals to prevent resealing during shipment or storage.

Once the bag 36 is received by the end user, unless the fastener 10 is left completely open, the first and second profiles 12, 26 must be separated. Ordinarily, this is accomplished by grasping flanges at the top of the bag 36, thereby pivoting the hook members 24 relative to the projections 32, and then pulling the profiles 12, 26 the rest of the way apart. Then, the bag 36 is filled and the profiles are pressed tightly together, so that the inner ribs 30 penetrate the grooves 22 so that the hook members 24 and projections 32 engage.

It will be apparent to those skilled in the art that various modifications and variations can be made to the structure and methodology of the present invention without departing from the scope or spirit of the invention. For example, the profiles may be formed by any number of methods including molding, and the profiles may be attached to any side of the bag, including the bottom. It also is understood that the profiles may include any number of ribs and the interlocking projections on the profiles may be any shape and size. In addition, projections may be spaced along the same side of the rib, or one may be on the top and another on the bottom.

In view of the foregoing, it is intended that the present invention cover modifications and variations of this invention provided they come within the scope of the appended claims and their equivalents.

What is claimed is:

1. A non-reopening plastic fastener comprising:

complimentary first and second profiles disposed adjacent and opposite to one another, said first and second profiles of substantial length and configured to interlock with one another;

said first profile includes a first base and first ribs integrally connected to said first base, each of said first ribs having a width, said first ribs including a main rib and two outer ribs disposed on opposite sides of said main rib, said first profile also includes first grooves spacing said outer ribs from said main rib, said first ribs having hook members projecting therefrom; and said second profile includes a second base and two inner ribs integrally connected to said second base, said two inner ribs adapted to be positioned within said first grooves, said two inner ribs having projections for engaging said hook members and for maintaining said second profile along said first grooves, said second profile also includes a pair of guide ribs integrally connected to said second base and disposed on opposite ends of said second profile, said first profile being movable into engagement with said second profile to lock said first and second profiles together along said hook members and projections, respectively.

2. The fastener of claim 1, wherein said first ribs of said first profile extend orthogonally from said first base.

3. The fastener of claim 2, wherein said first ribs have a plane perpendicular to said first base, said hook members of said first ribs having a contacting surface facing generally toward said first base at an orientation of about 40–80° from the plane of the first ribs.

4. The fastener of claim 2, wherein said first ribs have a plane perpendicular to said first base, said hook members of said first ribs having a contacting surface facing generally toward said first base at an orientation of about 50–70° from the plane of the first ribs.

5. The fastener of claim 1, wherein said two inner ribs and pair of guide ribs of said second profile extend orthogonally from said second base.

6. The fastener of claim 5, wherein said two inner ribs have a plane perpendicular to said second base, said projections of said two inner ribs having a contacting surface facing generally toward said second base at an orientation of about 40–80° from the plane of said two inner ribs.

7. The fastener of claim 5, wherein said two inner ribs have a plane perpendicular to said second base, said projections of said two inner ribs having a contacting surface facing generally toward said second base at an orientation of about 50–70° from the plane of said two inner ribs.

8. The fastener of claim 1, wherein said pair of guide ribs guide each of said two outer ribs between one of said two inner ribs and one of said pair of guide ribs.

9. The fastener of claim 8, wherein said pair of guide ribs guide said main rib between said two inner ribs.

10. The fastener of claim 1, wherein each of said two outer ribs have a single hook member, said hook member of each of said two outer ribs being directed toward said main rib.

11. The fastener of claim 1, wherein said main rib has two hook members, each of said two hook members being directed toward one of said two outer ribs.

12. The fastener of claim 1, wherein each of said two inner ribs have two projections, one of said two projections for engaging one of said hook members of said main rib and the other of said two projections for engaging one of said outer ribs.

13. The fastener of claim 1, wherein said first and second profiles are formed of low density polyethylene.

14. The fastener of claim 13, wherein said low density polyethylene includes between 30–120 ppm of a slip agent.

15. The fastener of claim 13, wherein said low density polyethylene includes approximately 60 ppm of said slip agent.

16. The fastener of claim 14, wherein said slip agent consists of Erucimide or Oleamide.

17. The fastener of claim 13, wherein said low density polyethylene includes between 500–2000 ppm of an anti-blocking agent.

18. The fastener of claim 13, wherein said low density polyethylene includes approximately 900–1100 ppm of an anti-blocking agent.

19. The fastener of claim 17, wherein said anti-blocking agent is diatomaceous earth.

20. A non-reopening plastic fastener comprising:

complimentary first and second profiles disposed adjacent and opposite to one another, said first and second profiles of substantial length and configured to interlock with one another;

said first profile includes a first base and first ribs integrally connected to and orthogonally extended from said first base, each of said first ribs having a width, said first ribs including a main rib and two outer ribs disposed on opposite sides of said main rib, said first profile also includes first grooves spacing said outer ribs from said main rib, each of said two outer ribs having a single hook member directed toward said main rib, said main rib having two hook members, each of said two hook member of said main rib being directed toward one of said two outer ribs; and said second profile includes a second base and two inner ribs integrally connected to and orthogonally extended from said second base, said two inner ribs adapted to be positioned with said first grooves, said two inner ribs having two projections for engaging one of said hook members of said main rib and said hook member of one of said outer ribs and for maintaining said second profile along said first grooves, said second profile also includes a pair of guide ribs integrally connected to said second base and disposed on opposite ends of said second profile, said pair of guide ribs guide each of said two outer ribs between one of said two inner ribs and one of said pair of guide ribs, said first profile being movable into engagement with said second profile to lock said first and second profiles together along said hook members and projections, respectively.

21. A tamper-evident bag comprising:

opposing wall panels having an open side;

a locking profile assembly extending a predetermined length along an inside surface of said wall panels proximate said open side, said locking profile assembly including:

first and second plastic profiles disposed adjacent and opposite to one another, said first and second profiles configured to interlock with one another;

said first profile includes a first base and first ribs integrally connected to said first base, each of said first ribs having a width, said first ribs including a main rib and two outer ribs disposed on opposite sides of said main rib, said first profile also includes first grooves spacing said outer ribs from said main rib, said first ribs having hook members projecting therefrom; and said second profile includes a second base and two inner ribs integrally connected to said second base, said two inner ribs adapted to be positioned with said first grooves, said two inner ribs having projections for engaging said hook members and for maintaining said second profile along said first grooves, said second profile also includes a pair of guide ribs integrally connected to said second base and disposed on opposite ends of said second profile, said first profile being movable into engagement with said second profile to lock said first and second profiles together along said hook members and projections, respectively.

22. The bag of claim 21, wherein said pair of guide ribs guide each of said two outer ribs between one of said two inner ribs and one of said pair of guide ribs.

23. The bag of claim 21, wherein each of said two outer ribs have a single hook member, said hook member of each of said two outer ribs being directed toward said main rib, said main rib has two hook members, each of said two hook member being directed toward one of said two outer ribs, and each of said two inner ribs have two projections, one of said two projections for engaging one of said hook members of said main rib and the other of said two projections for engaging one of said outer ribs.

24. The bag of claim 21, also including means disposed along the bag for obtaining access to the bag.

25. The bag of claim 24, wherein said access means includes perforations along at least one of said wall panels.

26. The bag of claim 24, wherein said access means includes a tear strip disposed along at least one of said wall panels.

27. The bag of claim 24, wherein said access means extends along said profile assembly.

28. The bag of claim 27, wherein said access means is oriented between 0.1–0.25 inches below the profile to permit opening of the bag.

29. The bag of claim 21, wherein the bag has a bottom opposite the open side, said wall panels having one of a hot air weld or sonic weld along the bottom of the bag.

30. The bag of claim 29, also including side seals along the side edges of the bag between the bottom and open side, said side seals including two spaced seals with one of said two spaced seals being a hot air weld and the other being a sonic welded.

31. The bag of claim 30, wherein two spaced seals have an air pocket approximately 0.25–0.5 inches wide between said two spaced seals.

32. The bag of claim 21, wherein said wall panels have a predetermined first strength and said locking assembly when in the locked position has a predetermined second strength against being opened, said second strength being greater than said first strength so that said wall panels will deform and tear before said locking assembly will open.

* * * * *